US006520516B2

(12) United States Patent
Favorito et al.

(10) Patent No.: US 6,520,516 B2
(45) Date of Patent: Feb. 18, 2003

(54) CONVERTIBLE SKATEBOARD/SCOOTER

(75) Inventors: Anthony Favorito, Buffalo, NY (US); Samuel Ogie, Tonawanda, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/742,102

(22) Filed: Dec. 22, 2000

(65) Prior Publication Data

US 2001/0002746 A1 Jun. 7, 2001

Related U.S. Application Data

(63) Continuation of application No. 09/271,208, filed on Mar. 17, 1999, now Pat. No. 6,199,880.

(51) Int. Cl.[7] ..... B62B 13/12; B62M 1/12

(52) U.S. Cl. ..... 280/87.042; 280/14.3; 280/87.05

(58) Field of Search ..... 280/87.042, 87.043, 280/87.041, 87.03, 87.05, 87.01, 87.021, 14.27, 655, 655.1, 47.315; 16/421, 900, 405, 429; 403/92, 93, 96

(56) References Cited

U.S. PATENT DOCUMENTS

| | | | | | |
|---|---|---|---|---|---|
| 1,213,454 | A | | 1/1917 | Brown | 280/87.042 |
| 1,336,100 | A | | 4/1920 | Shearer | |
| 1,387,675 | A | | 8/1921 | Worobow | |
| 1,578,415 | A | * | 2/1926 | Ferris | 280/14.2 |
| 2,170,978 | A | | 8/1939 | Smith | 280/87.05 |
| D183,647 | S | | 10/1958 | Clay | D34/15 |
| 3,236,539 | A | | 2/1966 | Ketterer | 280/87.01 |
| 4,025,082 | A | * | 5/1977 | Lummus | 280/14.27 |
| 4,061,351 | A | | 12/1977 | Bangle | 280/87.04 A |
| 4,093,252 | A | | 6/1978 | Rue | 280/87.04 A |
| D250,610 | S | | 12/1978 | Wynn | D34/15 |
| 4,129,313 | A | | 12/1978 | Benson | |

(List continued on next page.)

FOREIGN PATENT DOCUMENTS

| | | |
|---|---|---|
| DE | 3442193 A1 | 11/1985 |
| DE | 3537522 A1 | 4/1987 |
| FR | 643 299 | 9/1928 |
| FR | 2 467 003 | 4/1981 |
| GB | 227650 | 1/1925 |
| JP | 411033159 A | 2/1999 |
| JP | 411197289 A | 7/1999 |
| WO | WO 98/25677 | 6/1998 |

*Primary Examiner*—Brian L. Johnson
*Assistant Examiner*—Jeffrey Restifo
(74) *Attorney, Agent, or Firm*—Morgan Lewis & Bockius, LLP

(57) ABSTRACT

The convertible skateboard/scooter includes a base board with wheels coupled to a lower side of the base board. A handle is hinged to the base board and is movable between a first position in which the device can be used as a conventional skateboard, and a second position in which the device can be used as a conventional scooter. In the skateboard configuration, the handle is located adjacent a side surface of the device to provide a top surface that is unobstructed by the handle and upon which a user can stand while skateboarding. A parental lock can be located in the handle to lock the handle at either one of the first and second positions and to prevent the conversion of the device between the skateboard and scooter configurations by a child. An indent in the rear of the base permits the handle to be used for carrying the device when in the skateboard configuration.

35 Claims, 15 Drawing Sheets

U.S. PATENT DOCUMENTS

| | | | | | |
|---|---|---|---|---|---|
| 4,179,134 | A | | 12/1979 | Atkinson | 280/87.04 A |
| 4,183,546 | A | | 1/1980 | Heilig | 280/87.04 |
| 4,274,644 | A | * | 6/1981 | Taylor | 280/39 |
| 4,289,325 | A | * | 9/1981 | Whitacre | 280/87.04 |
| 4,533,150 | A | | 8/1985 | Hardy | |
| 4,707,884 | A | | 11/1987 | Chang | 16/113 |
| D304,360 | S | | 10/1989 | Curry | D21/227 |
| 4,886,297 | A | * | 12/1989 | Levine | 280/809 |
| 4,887,825 | A | * | 12/1989 | Allen et al. | 280/87.042 |
| 4,887,836 | A | * | 12/1989 | Simjian | 280/651 |
| 4,929,208 | A | | 5/1990 | Corica | 441/75 |
| 5,020,827 | A | * | 6/1991 | Murdoch | 280/816 |
| 5,100,161 | A | | 3/1992 | Tillyer | 280/87.042 |
| D326,701 | S | | 6/1992 | DelBosque et al. | D21/227 |
| D328,316 | S | | 7/1992 | Rogers | D21/71 |
| 5,221,111 | A | * | 6/1993 | Younger | 280/809 |
| 5,249,823 | A | * | 10/1993 | McCoy et al. | 280/656 |
| 5,299,816 | A | * | 4/1994 | Vom Braucke et al. | 280/655.1 |
| D352,921 | S | | 11/1994 | Pepe | D12/110 |
| 5,419,570 | A | | 5/1995 | Bollotte' | 280/47.041 |
| 5,474,314 | A | | 12/1995 | Lehman | 280/87.042 |
| 5,516,126 | A | | 5/1996 | Myers | 280/14.3 |
| 5,551,717 | A | | 9/1996 | De Courcey Milne | 280/87.042 |
| 5,794,955 | A | | 8/1998 | Flynn | 280/87.042 |
| 5,855,385 | A | | 1/1999 | Hambsch | 280/87.042 |
| 5,876,049 | A | * | 3/1999 | Spear et al. | 280/47.371 |
| 5,975,229 | A | | 11/1999 | Hosoda | 180/181 |
| 5,997,018 | A | | 12/1999 | Lee | 280/87.042 |
| 6,012,539 | A | | 1/2000 | Patmont | 180/223 |
| 6,024,376 | A | * | 2/2000 | Golichowski et al. | 280/655.1 |

* cited by examiner

CONVERTIBLE SKATEBOARD/SCOOTER

This is a continuation of application Application Ser. No. 09/271,208 filed on Mar. 17, 1999, now U.S. Pat. No. 6,199,880.

FIELD OF THE INVENTION

The invention relates generally to skateboards and in particular to a skateboard with a moveable handle that permits the skateboard to be configured as a scooter.

BACKGROUND OF THE INVENTION

Scooters and skateboards are well known manually propelled vehicles that can be used for both recreation and transportation by children and adults. A conventional skateboard includes a board with one or more wheels attached to its lower surface. The board is typically large enough to fit a user's feet onto the top surface when the user is standing with legs slightly spread apart and facing perpendicular to a direction of travel for the skateboard. In addition, the conventional skateboard typically includes four wheels that are flexibly attached in pairs to the lower surface of the skateboard. A first pair of wheels is flexibly attached to the front of the board and a second pair of wheels is flexibly attached to the rear of the board by front and rear trucks, respectively. The trucks are configured such that when a user's weight is shifted to a first side of the skateboard, each pair of wheels turns in an opposite direction relative to the other pair of wheels to steer the skateboard towards the first side of the skateboard.

By contrast, a conventional scooter is essentially a skateboard with a handle attached to the front end of the board. The scooter's board, however, is typically larger than that of a skateboard. In addition, although many conventional scooters include a two pair wheel arrangement similar to the wheel arrangement described above with regard to a conventional skateboard, some scooters include only a front wheel and a back wheel. The conventional scooter's handle typically extends two to four feet high (to approximately waist height of the user) and is used to provide leverage for propelling the scooter as well as provide steering for the scooter. In operation, a user places one foot on the top surface of the board of the scooter and pushes off a traveling surface with the other foot to propel the scooter. Once enough speed is attained, the user can coast with both feet placed on the top surface of the board. The scooter is steered by a combination of manipulation of the handle and shifting of the user's weight.

One variation of the standard scooter is disclosed in U.S. Pat. No. 4,707,884 to Chang (Chang'884). Chang'884 teaches the use of a foldable handle attached to a skateboard and is specifically directed to the locking hinge that connects the handle to the skateboard. The locking hinge mechanism is permanently mounted on the top surface of the base board and is lockable between an upright "operative" position in which the device can be operated as a conventional scooter, and a rest position in which the handle can be folded to rest upon the top surface of the r base board to compactly store the device in a garage or other storage place.

Another scooter that includes a hinged handle connected to a wheeled platform is disclosed in U.S. Pat. No. 1,387,675 to Worobow (Worobow'675). The scooter disclosed in Worobow '675 has a handle with a steering member running through the center of the handle and attached to a front set of wheels. The steering member pivots within the handle and is connected to the front set of wheels such that the wheels can be rotated to steer the scooter. The entire handle is pivotally coupled to the platform of the scooter such that the handle can be collapsed onto the top surface of the platform to facilitate storage of the scooter.

The devices disclosed in Chang'884 and Worobow'675 are essentially foldable scooters. Neither device can be used as a skateboard because in the handle's stowed position, it obstructs the top surface of the board. Although other known scooters have handles that can be removed to allow the scooter to be used as a skateboard, a user requires tools to remove the handle, and the handle is separated from the skateboard, creating a storage problem.

SUMMARY OF THE INVENTION

The drawbacks of the prior art are overcome by the present invention, which provides a skateboard/scooter device that can be quickly and easily converted between a conventional skateboard and a conventional scooter. Conversion is accomplished by moving a handle between an upright scooter configuration and a stowed skateboard configuration. The handle can be disposed on the side of, and co-planar with the top surface of, the base board when in the skateboard configuration. A grip portion of the handle can be spaced from the back of the base board to provide a convenient carrying handle for the skateboard when in the skateboard configuration. When in the scooter configuration, the handle extends upwards at an angle from a front portion of the base board to provide an easily graspable handle for a user standing on the base board.

Riding a skateboard is a natural progression from (and more difficult than) riding a conventional scooter. Accordingly, for training purposes, a convertible skateboard/scooter greatly facilitates a user's learning of skateboarding while saving the user the cost of purchasing both a skateboard and a scooter. A convertible skateboard/scooter device is especially appropriate for use by children. A convertible skateboard/scooter provides both the training advantages and the safety features that are desired when the device is used by a child. In particular, a convertible skateboard/scooter device allows a child initially to learn conventional four wheel scooter riding while providing the opportunity to advance to skateboarding if the child desires. In addition, depending on the type of terrain on which the child will be traveling, a parent can determine whether the child should operate in the conventional scooter configuration or the skateboard configuration.

The invention provides even greater storage and carrying ability than that of the related art. Specifically, because the handle can be tucked on the side of the base board, the skateboard/scooter device will take up little more than the room needed for a conventional skateboard. When the handle is tucked on the side of the base board it can also serve as a carrying handle for the skateboard configuration. For example, in order to traverse a waterway, a mud path, or to walk the device uphill, a user can carry the skateboard/scooter device by the handle when the device is in its skateboard configuration.

A parent lock can also be incorporated into the handle to lock the device in either of the skateboard and scooter configurations. The lock is configured such that only an adult can unlock the skateboard/scooter device to switch between configurations. Accordingly, a parent can rest assured that a child will not convert the device between configuration without consent of an adult.

DETAILED DESCRIPTION OF PREFERRED EMBODIMENTS

A convertible skateboard/scooter embodying the principles of the invention is illustrated in FIGS. 1–14 and described below.

Figure 1:
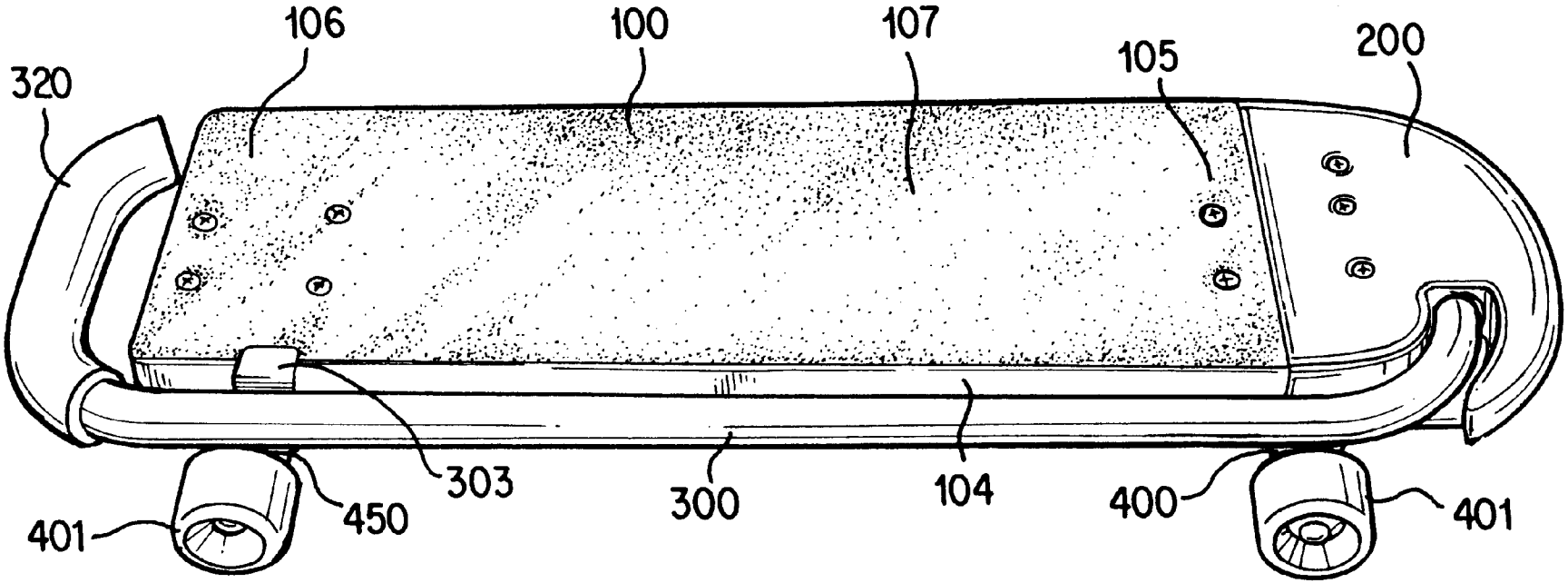
FIGS. 1 and 2 are perspective views of the convertible skateboard/scooter embodying the principles of the invention in the conventional skateboard and scooter configurations, respectively.
Figure 2:
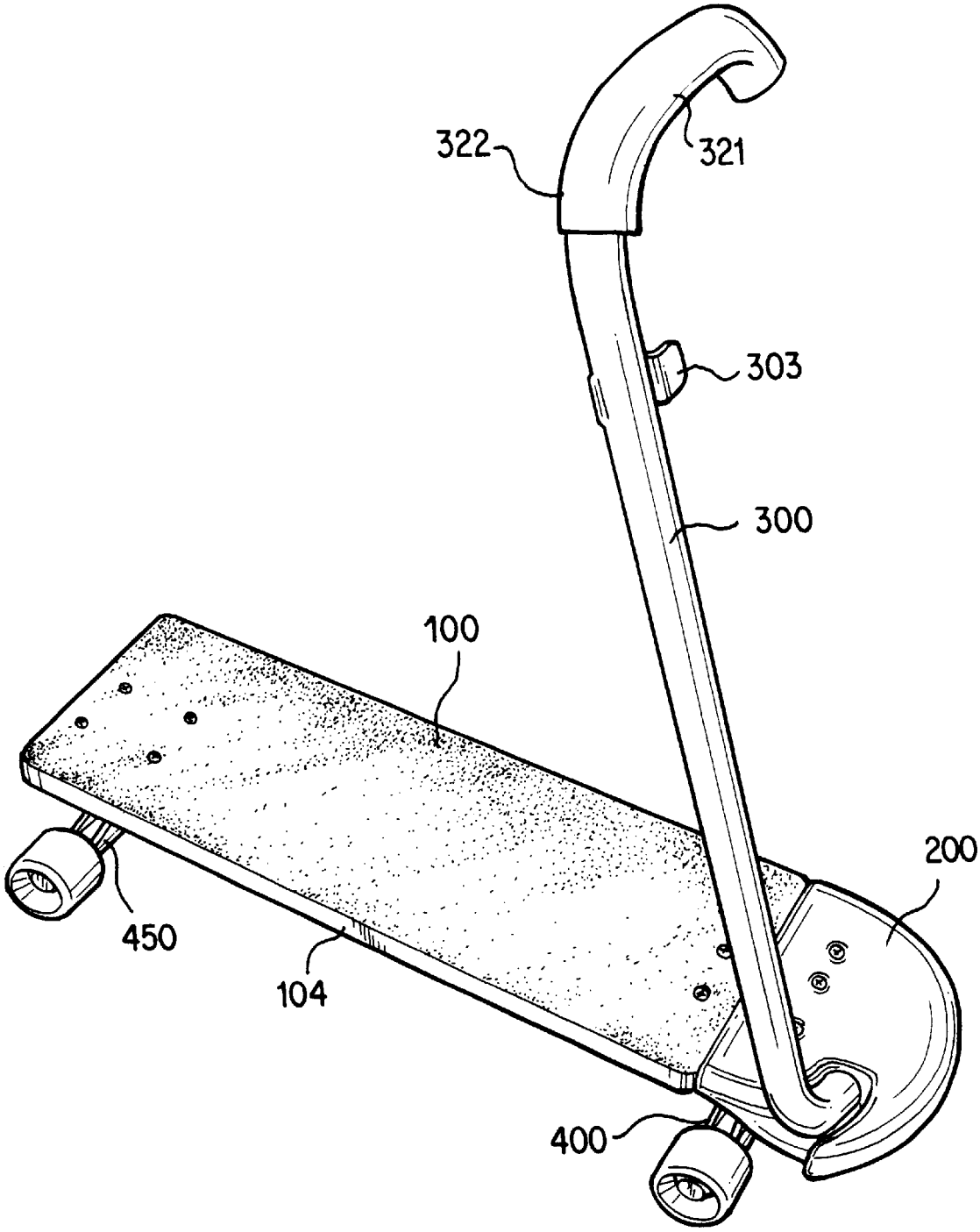
Figure 3:
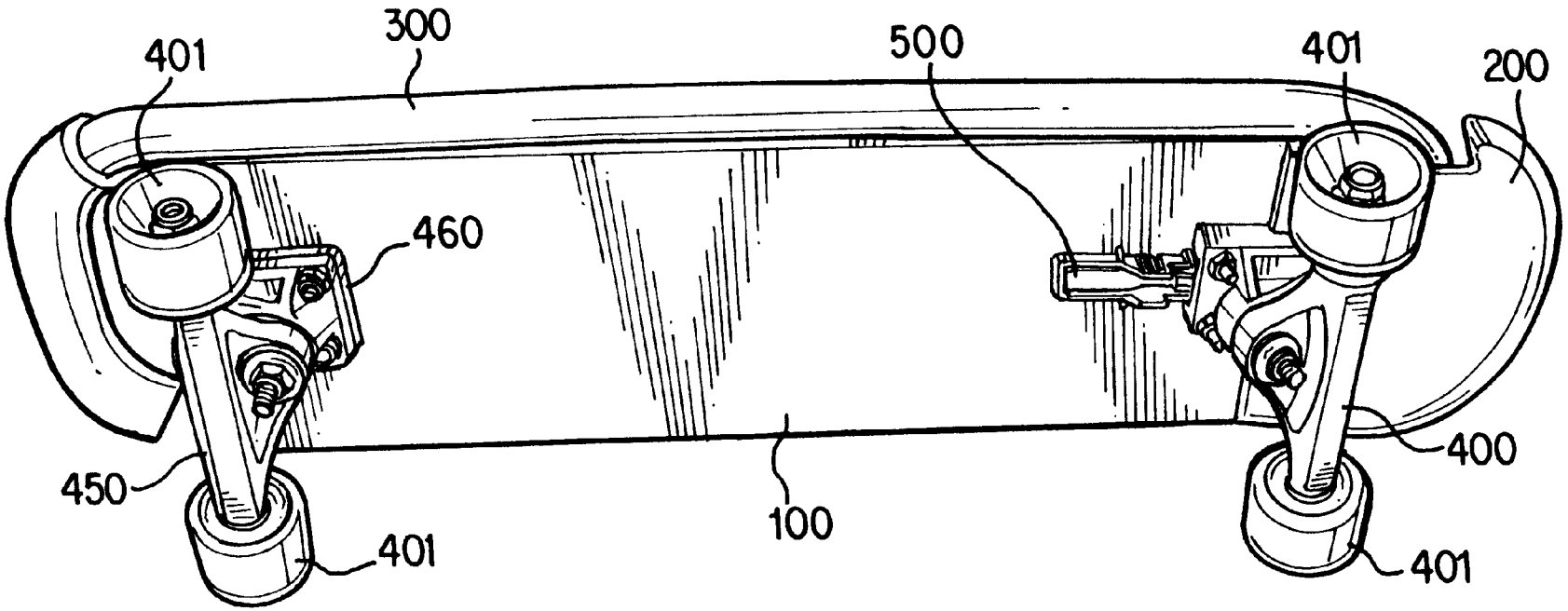
FIG. 3 is a bottom perspective view of the convertible skateboard/scooter of FIG. 1.
Figure 4:
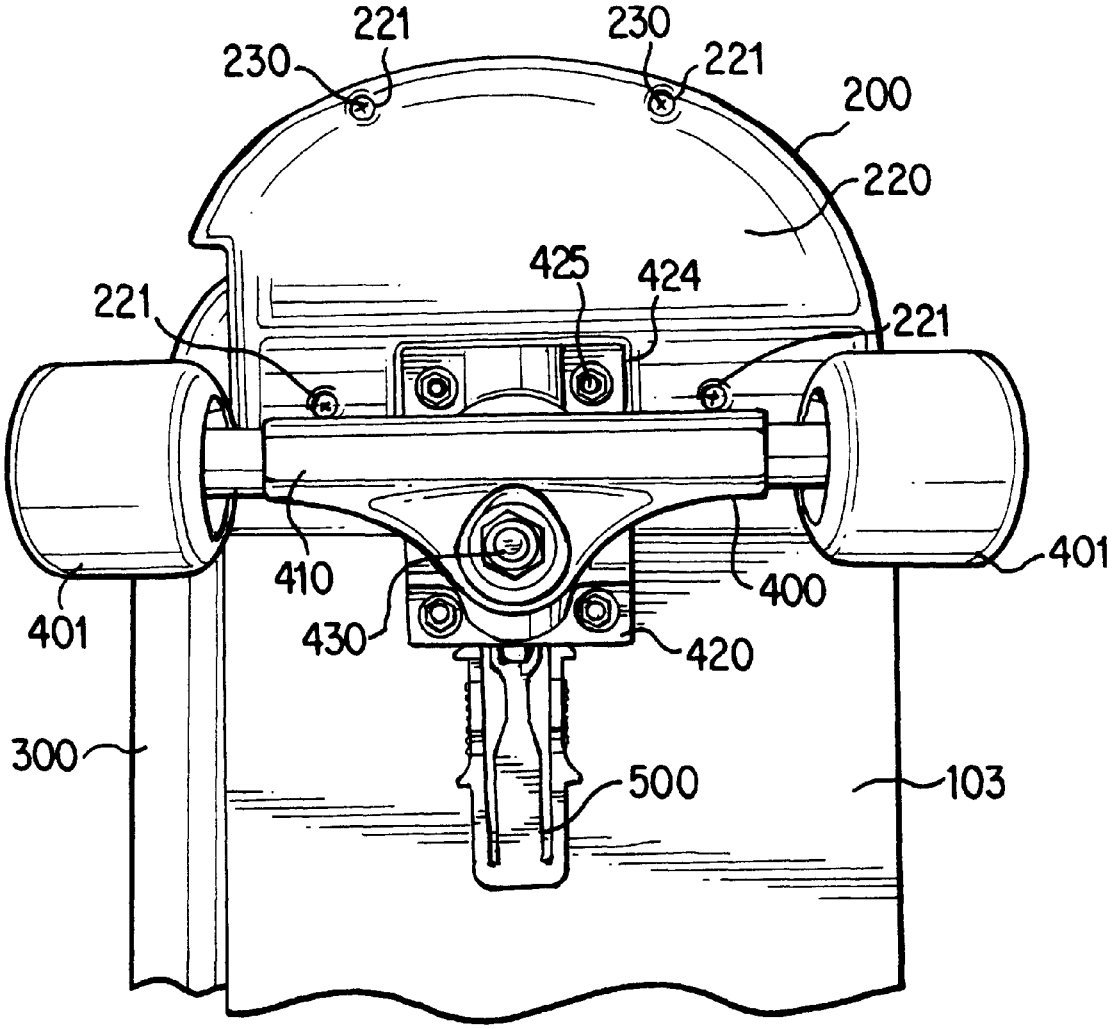
FIG. 4 is a bottom view of the front portion of the convertible skateboard/scooter of FIG. 1.
Figure 5:
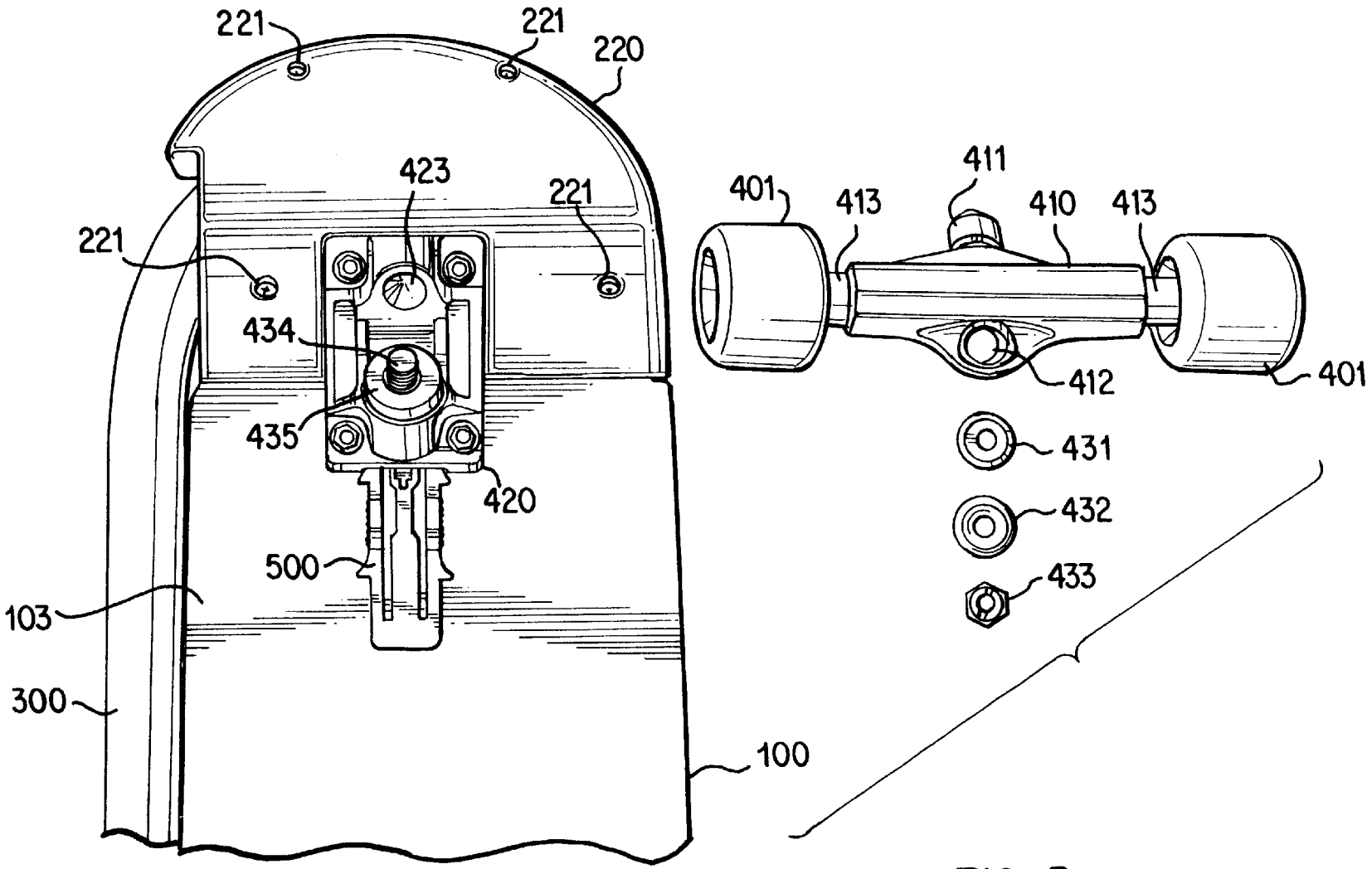
FIG. 5 is a semi-exploded view of the front portion of the convertible skateboard/scooter shown in FIG. 4.
Figure 6:
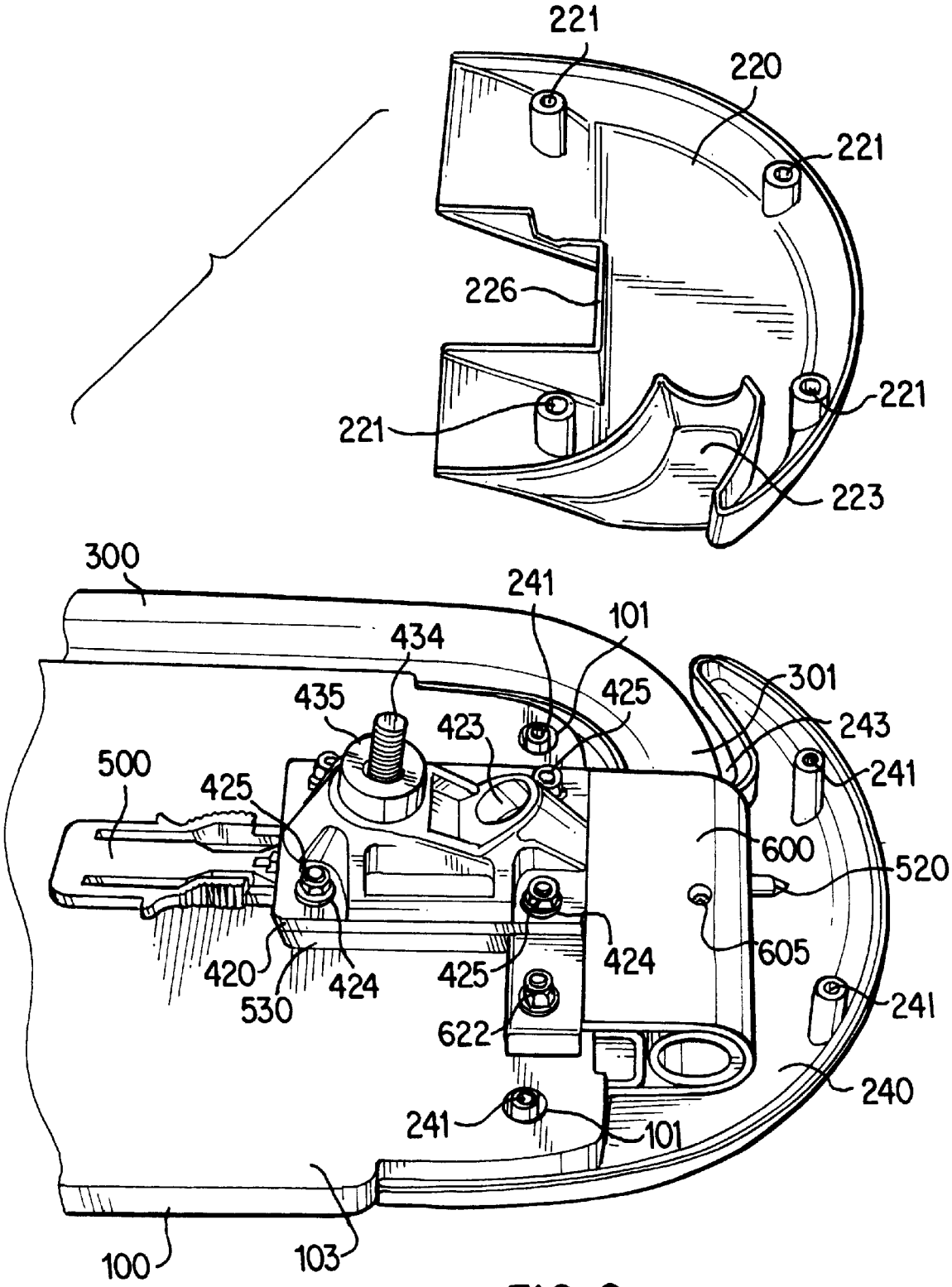
FIG. 6 is a partial, semi-exploded view of the convertible skateboard/scooter shown in FIG. 4.

As shown in FIG. 1, convertible skateboard/scooter i includes a base 100, front and rear wheel trucks 400 and 450, respectively, and a handle 300. Base 100 and wheel trucks 400, 450 are of conventional design. Base 100 includes a lower surface 103, a top surface 107, front and rear 105, 106, and right side 104, respectively. Wheels 401 are carried on wheel trucks 400, 450, which are attached to lower surface 103 of the base 100.

Handle 300 is attached to the front end of the base 100. Handle 300 is shown in FIG. 1 in its lower "stowed" position such that the convertible scooter/skateboard is in its skateboard configuration. In this position, middle portion 310 of handle 300 is located adjacent the right side 104 of the base such that essentially none of the handle portion extends above the top surface 107 of the base 100 or otherwise obstructs a user's access to the base's top surface 107 for the purpose of skateboarding.

Handle 300 is formed from metal tube, and includes an elongate middle portion 310 and a base end and a grip portion that each extend perpendicularly from either end of the middle portion 310. Grip portion 320 includes a top grip half 321 that is placed over a perpendicularly extending distal end of the metal tube and mates with a lower grip half 322 to sandwich the metal tube therebetween. The surface of the grip portion can be knurled or otherwise textured for greater gripping ability. At the opposite end of the handle middle portion 310, the metal tube forms a handle base end 301 that is perpendicular to the middle portion 310 and is rotatably connected to a handle bracket 600 (discussed in greater detail below) located at the front 105 of the base.

A latch 303 extends from a side of the handle's middle portion 310 to rest on the top surface 107 of the base and provide support for the handle 300 to prevent it from being bent if a user steps on it while in the "stowed" skateboard position adjacent the base 100.

In the stowed configuration, grip portion 320 is located adjacent to, and spaced from, the rear of the base 100 and provides a convenient carrying handle. Specifically, grip portion 320 extends approximately perpendicular to the handle middle portion 310 and is configured to create a space between the rear of the base 106 and the grip portion 320 to allow access for a user's hand.

In the scooter configuration, the handle middle portion 310 is inclined above the base 100 and extends upwardly from the right side of the front bumper 200. Grip portion 320 extends generally perpendicular to the middle portion 310. The handle's middle portion 310 is of such a length as to permit a user to easily grasp the grip portion 320 when standing on the base 100. A handle lock 500 (discussed in greater detail below) is incorporated into the front wheel truck 400 to lock the handle 300 in either the scooter configuration or skateboard configuration.

As shown in FIGS. 3–7, a front bumper 200 encloses the handle base end 301 and handle bracket 600, and includes a front bumper lower portion 220 fastened to a front bumper upper portion 240 to encase the handle base end 301 and handle bracket 600. The front bumper lower portion 220 includes a channel 223 that receives the handle base 301. Front bumper upper portion 240 includes fastener shafts 241 that mate with apertures 221 in the front bumper lower portion 220 such that fasteners 230 can secure the upper and lower front bumper portions together. Fastener shafts 241 extend through apertures 101 in the base 100 to positively lock the front bumper 200 and base 100 relative to each other. In addition, apertures 224 located in the front bumper upper portion 240 align with apertures 624 of the handle bracket 600 and apertures 124 in the base 100 to permit fasteners 425 and 625 to fasten the front bumper 200 to the base 100 and handle bracket 600.

The front truck 400 is attached to the base lower surface 103 with fasteners 425. Truck 400 includes a front t-bar 410 that is attached to a front base block 420 by a truck joint fastener 430. The front t-bar 410 includes a truck joint aperture 412 through which the truck joint fastener bolt 434 extends. Wheels 401 are attached to axles 413 located on either end of the t-bar 410. A guide post 411 extends from a central portion of the t-bar 410 and is pivotally housed within a recess 423 in the front base block 420. The truck joint fastener 430 includes a bolt 434 that is held within an aperture 427 in the front block 420 and is attached to the t-bar 410 by a first elastomeric member 431, washer 432, and nut 433. The truck joint fastener 430 includes a second annular elastomeric member 435 that is sandwiched between the front t-bar 410 and the front base block 420 to provide the flexibility necessary for turning the wheels 401 of the truck 400.

Figure 7:
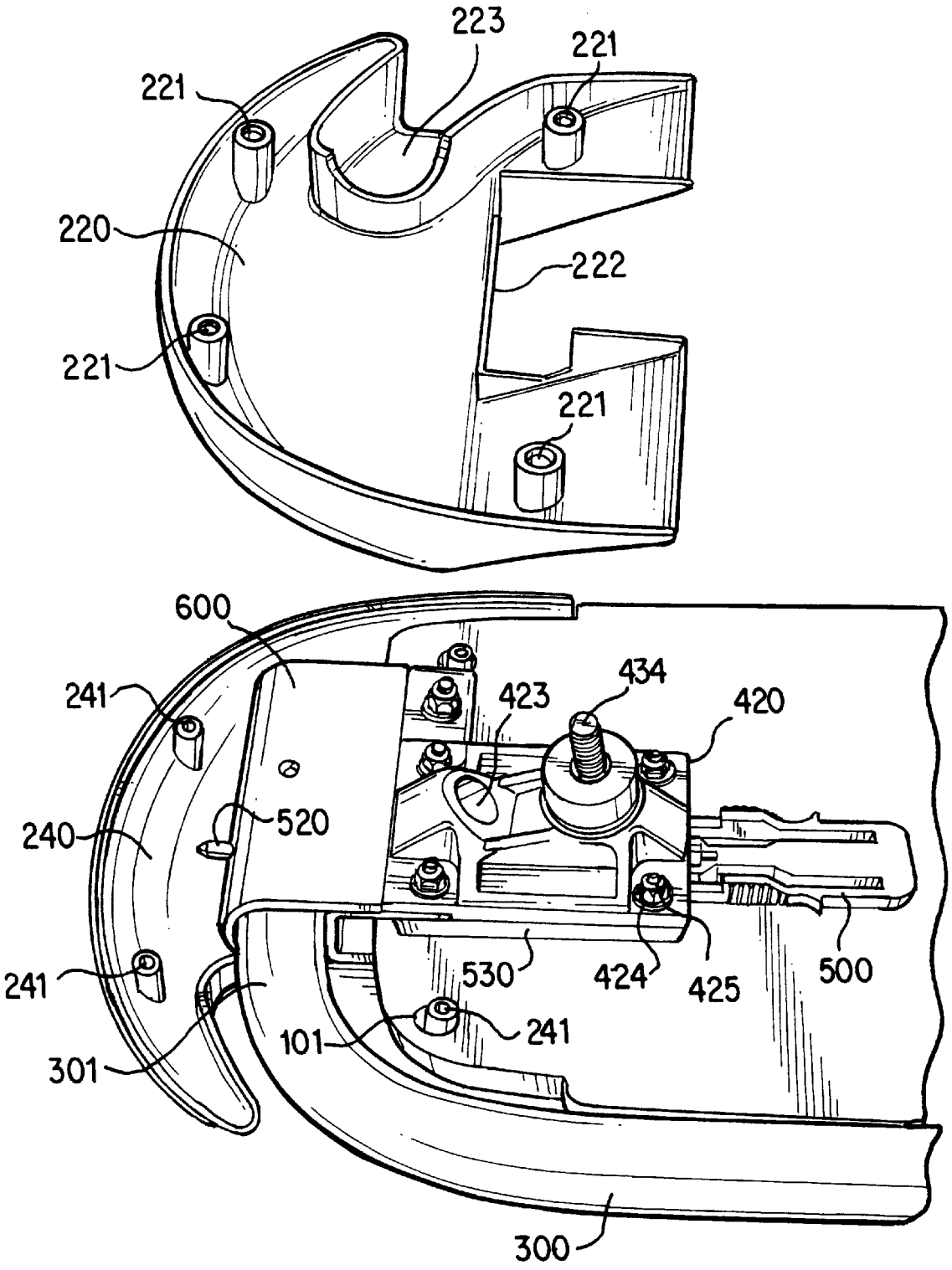
FIG.7 is a second partial, semi-exploded view of the convertible skateboard/scooter shown in FIG. 4.

As shown in FIGS. 8–12, handle bracket 600 is attached to the base 100 via fasteners 625 that extend through apertures 124, 424 and 624 in the base 100, front base block 420 and handle bracket 600, respectively. The handle bracket 600 is generally U-shaped and has a wall 604 connecting between, and reinforcing, a top portion 620 and bottom portion 630 which form the U-shaped sides of the handle bracket 600. The top portion 620 extends upward further than the bottom portion 630 of the U-shaped bracket 600. Three apertures 624 are located in each of the upper and lower portions 620 and 630 and are aligned with each other to allow fasteners to pass therethrough and attach the handle bracket to the base 100. A lip 603 is located on the bottom portion 630 of the handle bracket to provide a flush, coplanar surface when front base block 420 is attached on top of the handle bracket 600 as best shown in FIG. 7.

Figure 8:
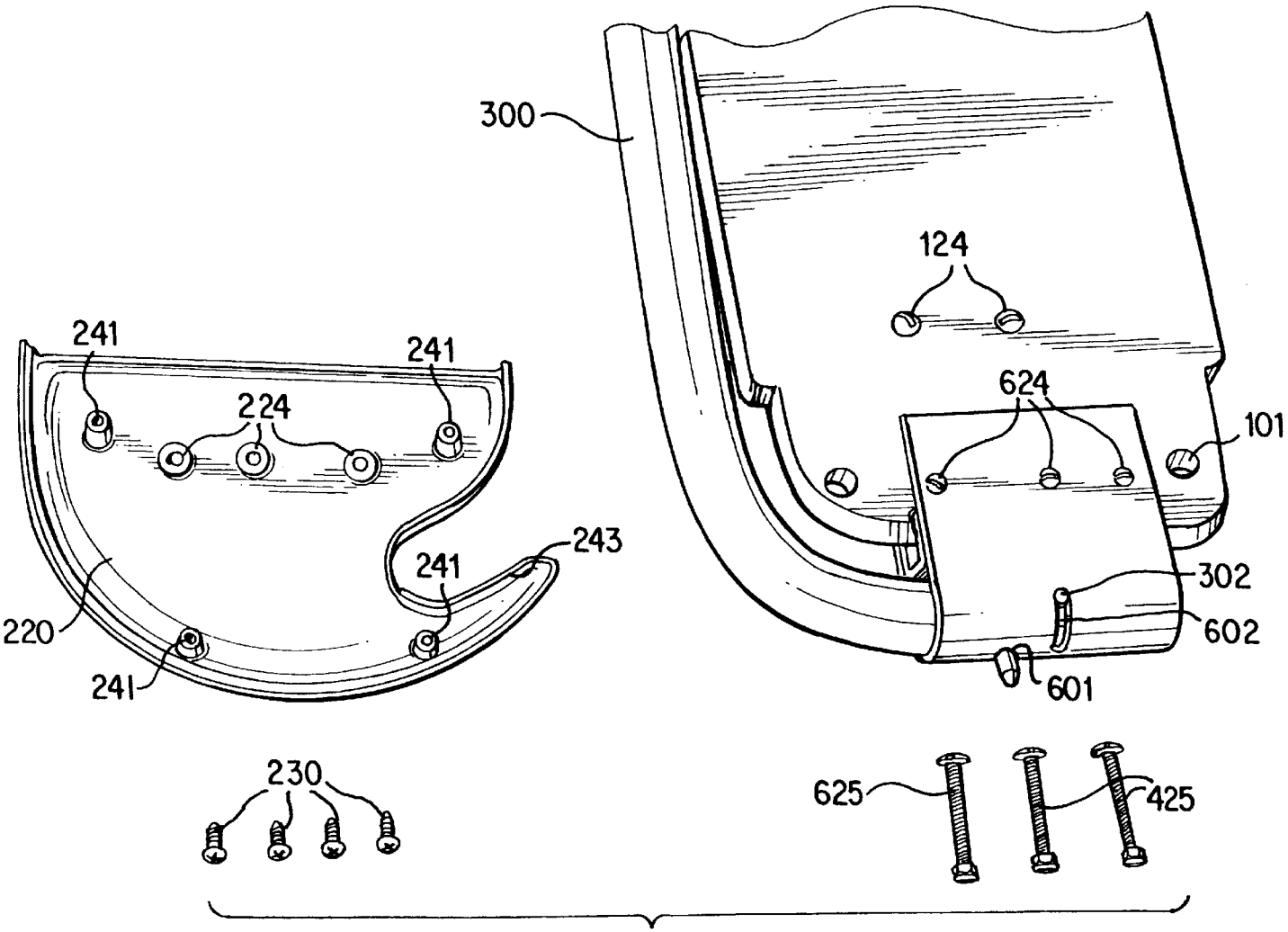
FIG. 8 is a partial, semi-exploded top perspective view of the convertible skateboard/scooter shown in FIG. 1.
Figure 9:
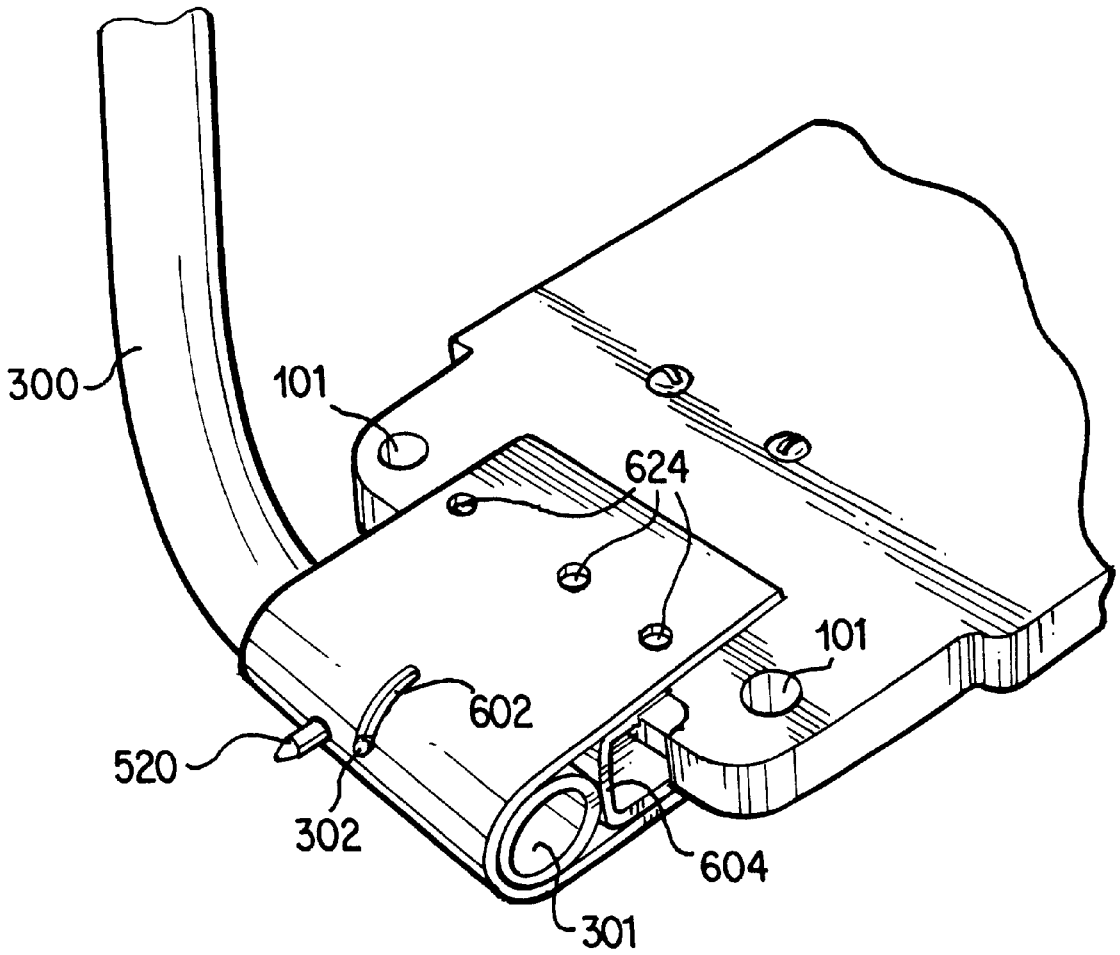
FIG. 9 is a perspective view of the base, handle bracket and handle of the convertible skateboard/scooter of FIG. 2.
Figure 10:
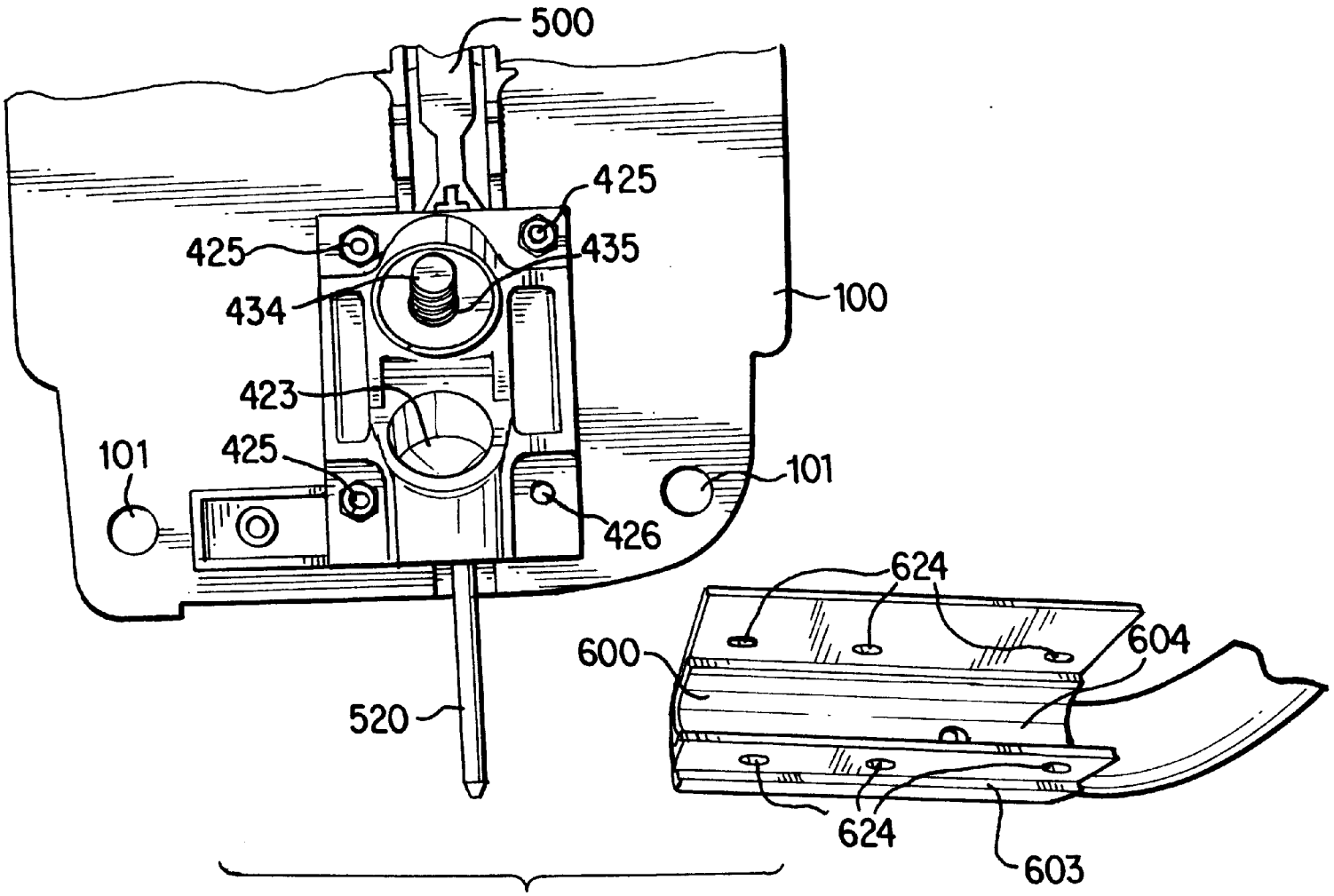
FIG. 10 is a perspective view of the handle, handle bracket, handle lock, base, front base block and lock housing of the convertible skateboard/scooter of FIG. 1.

As shown in FIGS. 8–10, several features of the handle bracket 600 work in conjunction with the handle lock 500 to secure the handle in either of its skateboard and scooter configurations. A lock aperture 601 is located at a central portion at the base of the U-shaped handle bracket. The lock aperture 601 is also rotationally aligned with scooter throughholes 350 and skateboard throughholes 360, both of which are located in the same circular plane in base end 301 of the handle 300. Accordingly, a spring biased lock extension 520 can pass through the lock aperture 601 and scooter throughholes 350 to lock the handle 300 and base 100 in the scooter configuration. Similarly, the spring biased lock extension 520 can pass through the handle lock aperture 601 and skateboard apertures to lock the handle with respect to the base 100 in the skateboard configuration.

A slot 602 located on a central portion of the handle bracket 600 cooperates with stop 302 of the handle 300 to limit the travel of the handle 300 between the scooter configuration and the skateboard configuration. Stop 302 can be a dowel shaped pin that is screwed through the base end 301 of the handle. The stop 302 can be accessed through stop access hole 605 located on the bottom portion 630 of the handle bracket 600.

Figure 11:
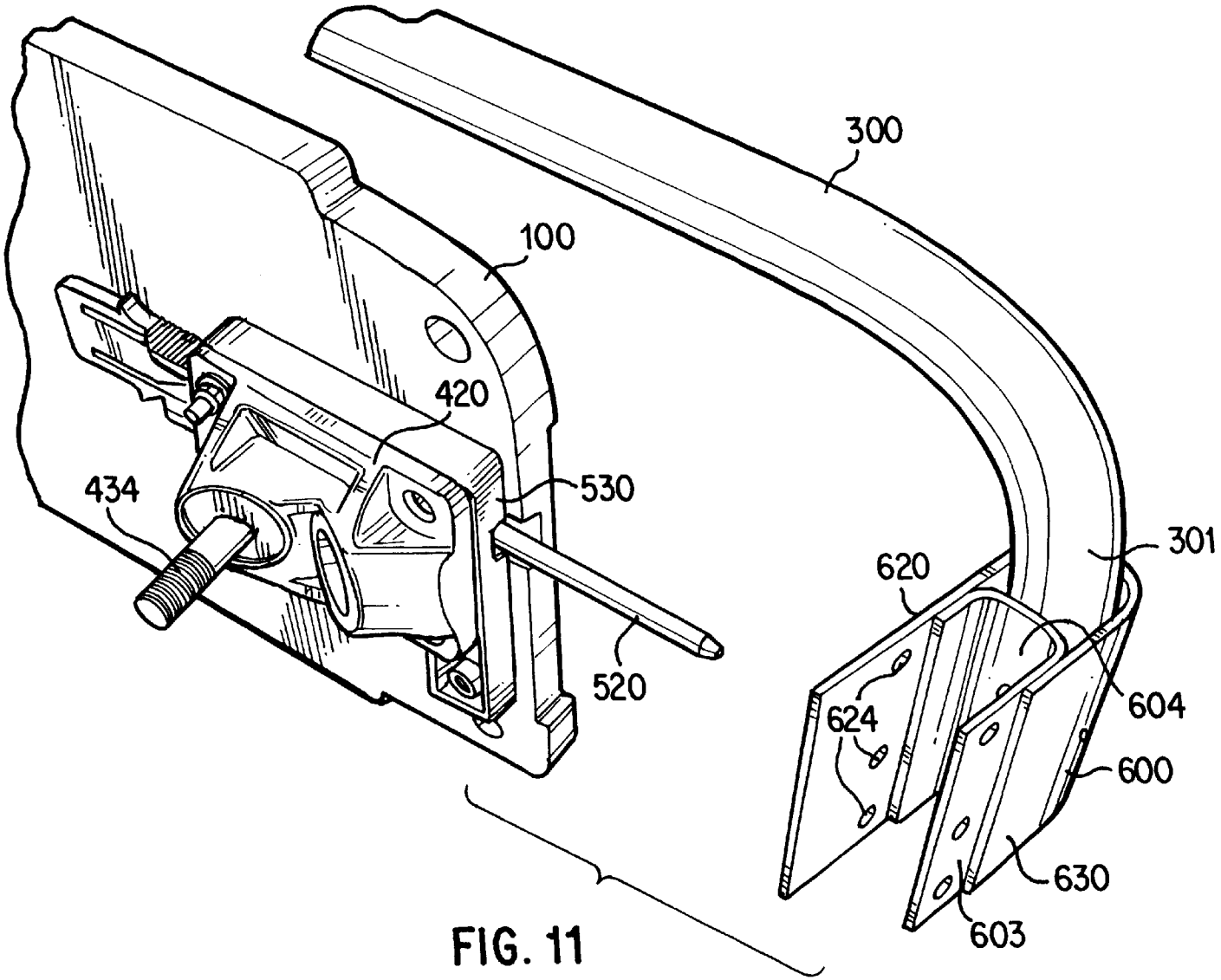
FIG. 11 is a second perspective view of the handle, handle bracket, handle lock, base, front base block and lock housing of the convertible skateboard/scooter of FIG. 1.
Figure 12:
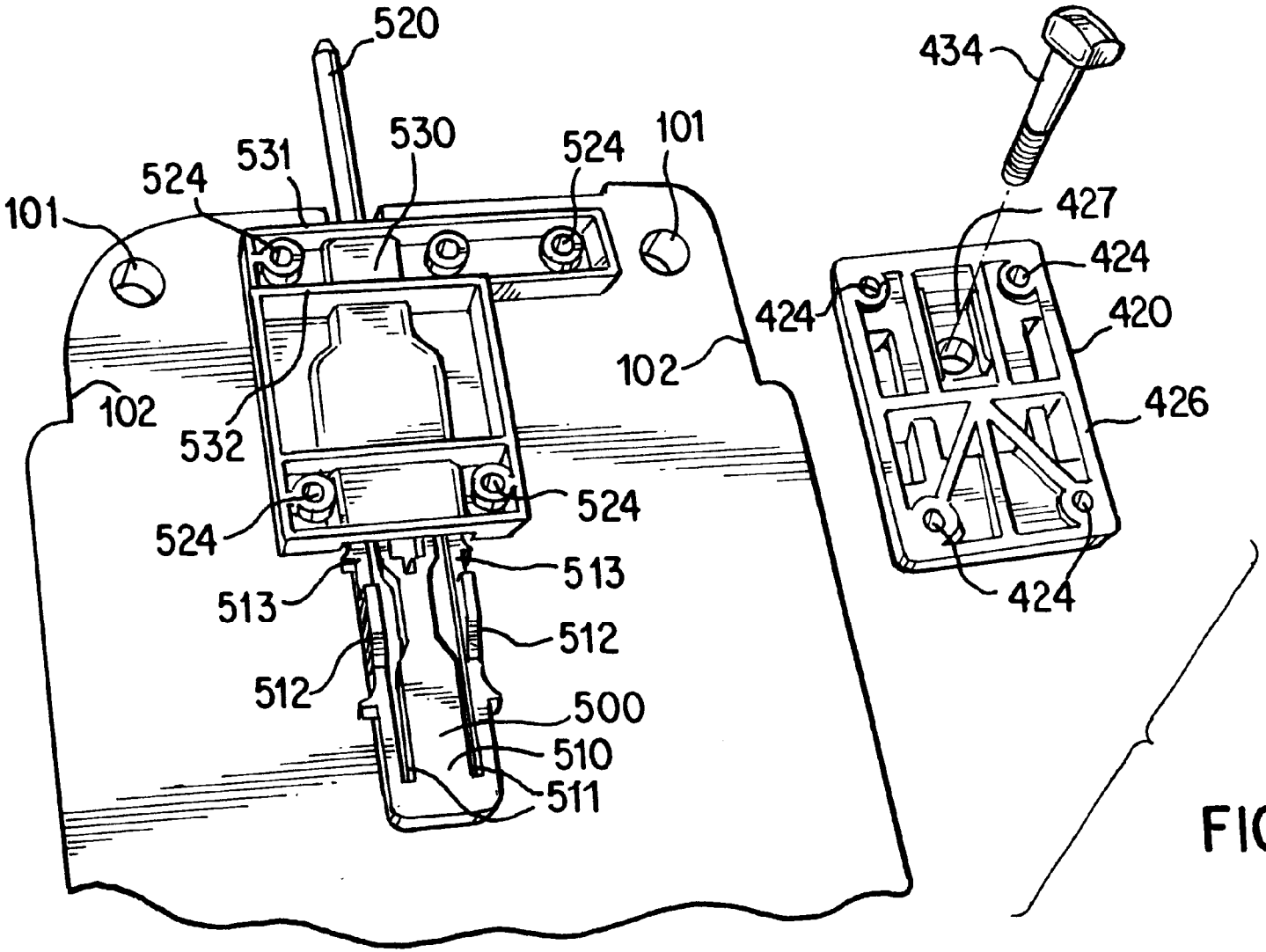
FIG. 12 is a perspective view of the handle lock, base and front base block of the convertible skateboard/scooter of FIG. 1.

As shown in FIGS. 10–12, front base block 420 is sandwiched between t-bar 410 and the lock housing 530. Lower surface 426 of the front base block 420 is shaped as a planar rectangle and mates with both the rear lower surface 532 of the handle lock housing 530 and a portion located above the lip 603 of the handle bracket bottom portion 630. The base block 420 includes an aperture 426 through which the truck joint fastener bolt 434 extends, and which is angled slightly away from the lower surface 103 of the base and towards the front 105 of the base. A guide post recess 423 is located adjacent aperture 426 and is configured to house the guide post 411 and permit the guide post 411 to pivot therein. The guide post recess 423 is angled slightly away from the lower surface 103 of the base and towards the rear 106 of the base.

The brake lock housing 530 is generally L-shaped and includes a planar rear lower surface 532 that is slightly elevated with respect to a planar front lower surface 531. Accordingly, a portion of the U-shaped handle bracket 600 can mate with the planar front lower portion 531 to create a co-planar surface with the planar rear lower surface 532 to smoothly abut and attach to the planar lower surface 426 of the base block 420. The upper surface 535 of the brake lock housing 530 is planar and includes a slider indent 536 in which a slider 510 can travel. Several apertures 424 run through the perimeter of the lock housing to allow the various fasteners to pass through and lock the structure to the base 100.

Figure 13:
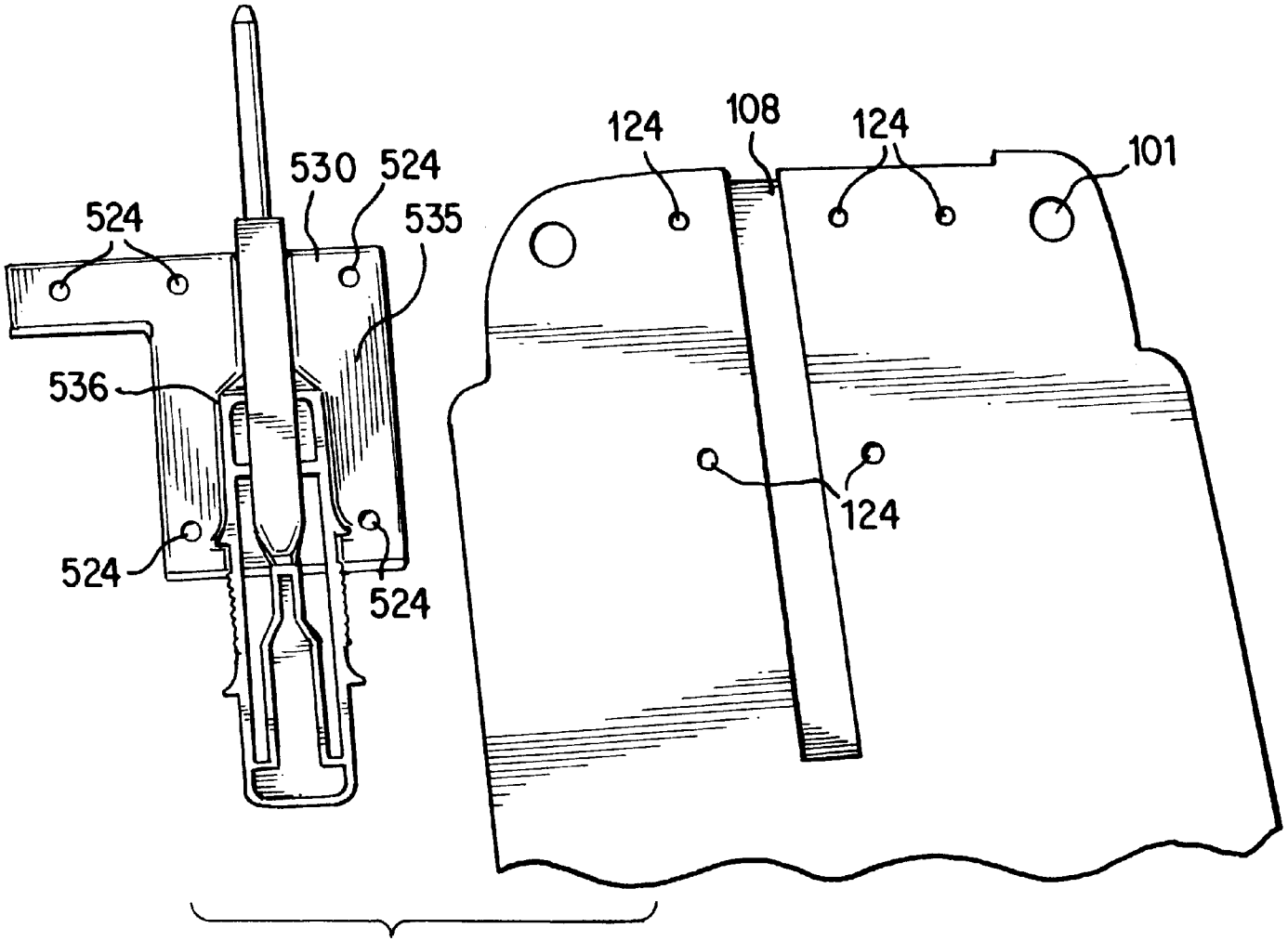
FIG. 13 is a perspective view of the handle lock and base of the convertible skateboard/scooter of FIG. 1.
Figure 14:
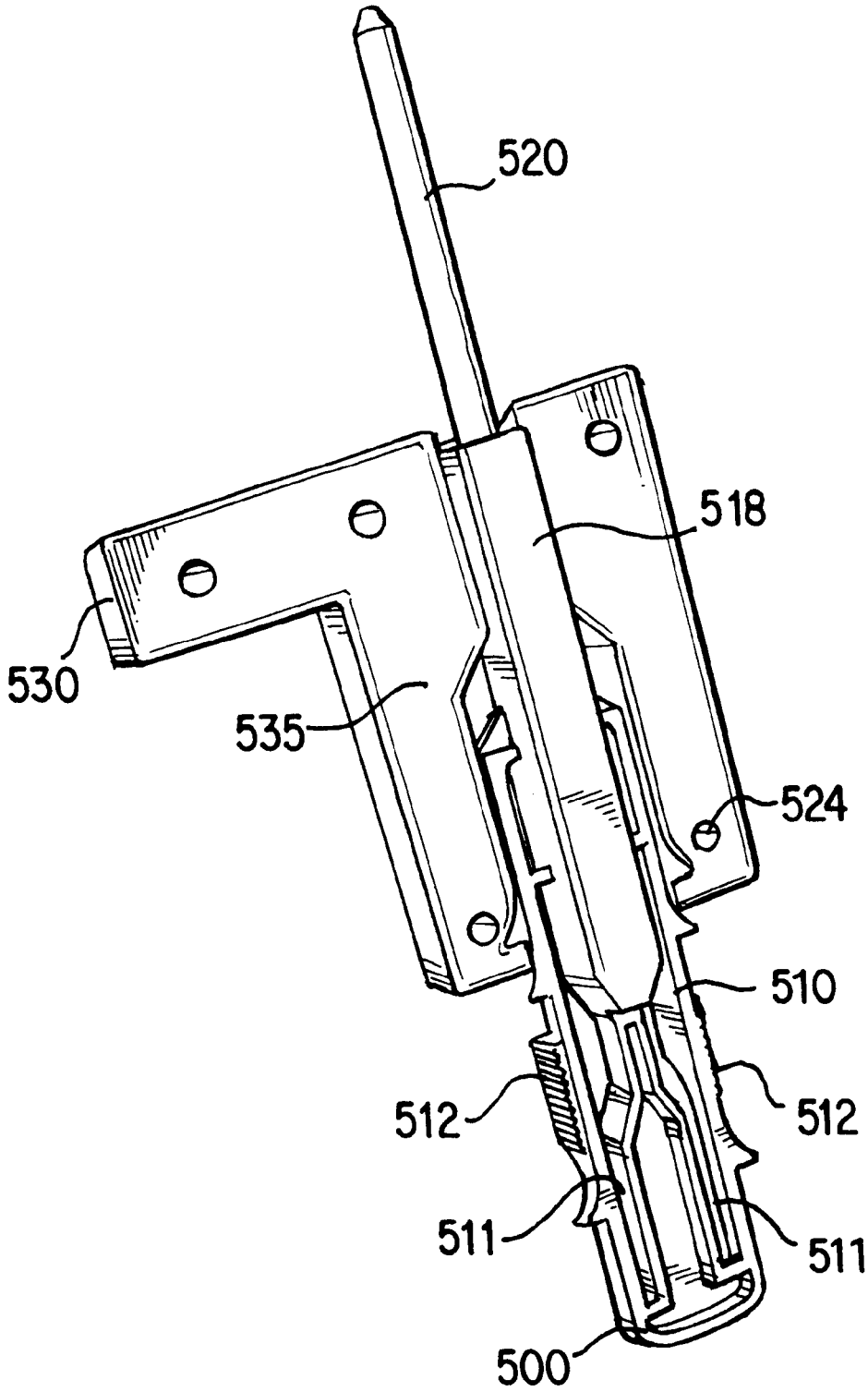
FIG. 14 is a top view of the handle lock of the convertible skateboard/scooter of FIG. 1.
Figure 15:
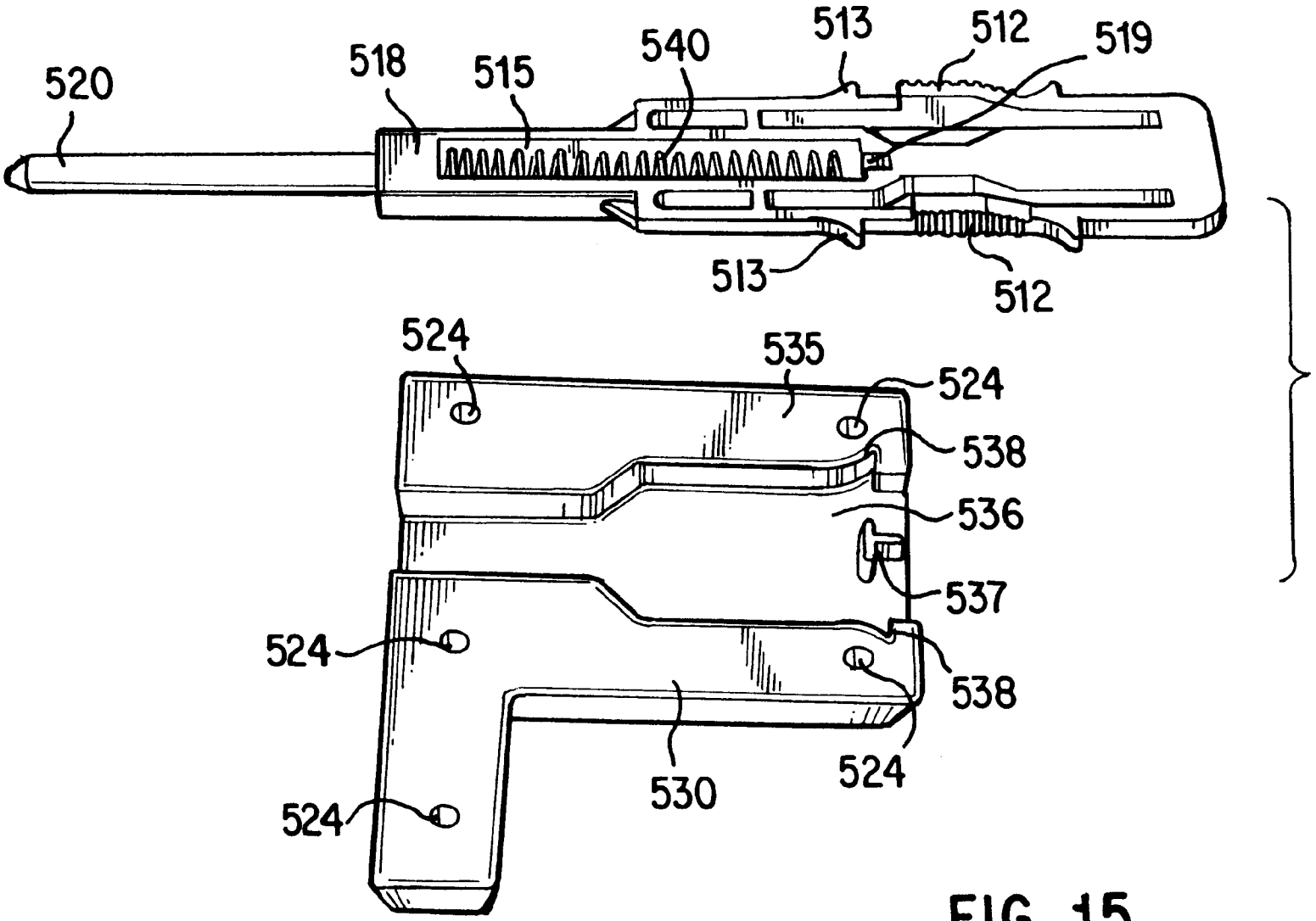
FIG. 15 is an exploded view of the handle lock for the convertible skateboard/scooter of FIG. 14.

As shown in FIGS. 13–15, slider 510 is nested in the slider indent 536 of the lock housing 530 such that it can be slid along a longitudinal axis of the lock housing. A lock extension 520 is preferably formed as a metallic dowel pin and is press fit into a distal end 518 of the slider. Lock clips 513 are provided on either side of the slider 510 and mate with like-shaped clip indents 538 in the lock housing 530 to lock the slider in a fully extended position (as shown in FIG. 13). Press bars 512 located on either side of the slider 510 are inwardly flexible due to slots 511 running along either side of the longitudinal axis of the slider 510. Accordingly, the slider 510 can be unlocked from its fully extended position by applying an inward force to both of the press bars 512 to release the lock clips 513 from the clip indents 538. The force required to unlock the slider can be varied by varying the size of the slots 511 in the slider. Preferably, the amount of force required is greater than that which a small child can produce, but low enough such that an adult can easily perform the unlocking operation.

Once the slider is unlocked from the housing 530, the slider can be slid along its longitudinal axis and in a direction out of the lock housing 530 against the bias of spring 540. Spring 540 is located within a spring slot 515 in the slider 510 and is biased against spring stop 537 located in the indent 536 of the lock housing 530 to urge the slider into the fully extended position. A cooperating surface 519 of the spring slot 515 (as best seen in FIG. 15) is configured to mate with the spring stop 537 and further secure the slider when it is in its fully extended position.

In operation, when the slider is in its fully extended position, the lock extension 520 extends through one of the two throughholes in the handle (either the skateboard throughhole 350 or the scooter throughhole 360) and through the lock aperture 601. Because the lock aperture 601 is not movable with respect to the base 100, the handle 300 is effectively locked in either the skateboard configuration or the scooter configuration when the slider is in its fully extended position.

To change configurations between the skateboard configuration and the scooter configuration, the slider press bars 512 are forced together to release the lock clips 513 from the clip indents 538 in the lock housing and permit the slider to be pulled backwards out of the lock housing 530. Once the lock extension 520 is completely removed from lock aperture 601 and skateboard throughholes 360, the handle is free to rotate upwardly and away from the top surface 106 of the base (the handle cannot rotate in the opposite direction due to the interaction of slot 602 with the stop 302 of the handle). The spring 540 acts against spring stop 537 in the lock housing to bias the slider 510 and lock extension 520 towards the handle.

Accordingly, when the handle is rotated to a position in which the scooter throughhole align with the lock extension 520, the spring will force the lock extension 520 through the scooter throughhole and lock aperture 601 to lock the handle in its scooter configuration. The spring also forces the slider 510 back in to the lock housing 530 such that lock clips 513 are snapped back into the clip indents 538 of the lock housing and the slider is locked in the lock housing. To change the configuration back to the skateboard configuration, the same operation is undertaken except the handle is oppositely rotated.

The distal end 518 of the slider is a generally elongate rectangular block shape with an aperture at its distal end for press fitting the lock extension 520 therein. As shown best in FIG. 14, a portion of the distal end 518 extends beyond the planar upper surface 535 of the lock housing. Accordingly, a rectangular groove 108 is formed in the lower surface of the base 100 to accommodate the distal end 518 and permit the lock housing 530 to lie flush against the lower surface 103 of the base.

The rear wheel truck 450 can be configured similar to the front wheel truck, but without connection to a lock housing, slider and handle bracket. A spacer block 460 can be sandwiched between the rear base block 470 and the lower surface 103 of the base to ensure that all wheels 401 are equally spaced from the lower surface 103 of the base 100. Moreover, a spacer block can be used to ensure that the space taken up by the lock housing, slider and handle bracket in the front truck is compensated for in the rear truck to ensure that the wheels are spaced equally from the lower surface 103 of the base 100.

Many variations on the structures and functions of the illustrated embodiment are contemplated. Although the handle is shown attached to the right side of the base, the handle could be mounted to the left side for easier manipulation by a left handed user. Similarly, although illustrated as being stowed along the side of the base, the handle could alternatively be stowed in an indent or recess in the upper surface of the base, or beneath the base. The specific location of the handle can be varied provided that it does not obstruct access to the top surface of the base board when the handle is in the "stowed" skateboard configuration.

The base board can be configured in various styles besides that disclosed in the depicted embodiment. For example, a base board with a large tail fin could be used such that the grip portion 320 of handle 300 can be stowed beneath the tail fin and a user can steer the skateboard via the fin.

The specific materials used to construct the invention can be selected from those known in the art. The base 100 can be made from wood, metal, plastic, carbon fiber and/or other materials. In addition, the base can include a tacky layer adhered to its top surface to provide a no-slip surface to a user. The tacky layer can include a sand paper, a gummy based adhesive or other known tacky material. The trucks 400 and 450 and handle 300 are preferably made from either plastic or metal, but can be made from other high strength lightweight materials such as rubbers, ceramics, carbon fiber, etc. The wheels can be made from rubber, plastics, or other known materials. The handle lock 500 can be composed of parts made from plastic, rubber, metal or other known materials. The lock extension should be made from a durable material such as metal, carbon fibers or other similar material that will repeatedly lock the handle with respect to the base 100.

Although the invention is illustrated with respect to a skateboard and scooter, a movable handle mechanism could be used on other devices, such as a water toy configurable between a knee-board type device and a stand up water scooter board.

Variations to the handle lock mechanism are also contemplated. For example, the handle lock mechanism can alternatively be configured as a spring loaded gear cap that is fit onto the base end 301 of the handle 300. The gear cap could include gear teeth that are biased into locking contact with mating teeth located on the handle 300 to rotatably fix the handle in place when in a first position, and could be movable against the spring bias to a second position in which the teeth are released from each other and the handle is free to rotate.

The handle is preferably U-shaped, with a base end 301 and grip portion 320 extending upwards and generally perpendicular to a middle portion 310. However, alternative configurations are contemplated. The handle can include an upper portion that is T-shaped and includes separate grip locations for the right and left hands of a user. The handle can include a pole shaped grip extension that extends linearly from the base end 301 with no perpendicular portion extending from the pole shaped grip extension.

Although in the preferred embodiment of the invention the skateboard/scooter device is described as a child's device, the inventive concepts disclosed herein can be utilized in skateboard/scooter devices suitable for adults.

What is claimed is:

1. A skateboard comprising:

a base having a top surface, a lower surface, a front portion, and a rear portion, and a peripheral edge;

first and second truck assemblies pivotally mounted to the lower surface of the base and each of the truck assemblies including:

a t-bar; and a pair of wheels mounted for rotation to the t-bar; and a handle coupled to the base at one of the front portion and the rear portion, the handle being movable between a first position wherein the handle extends upwardly from the base and a second position wherein the handle lies outside of the peripheral edge when viewed from above the top surface.

2. The skateboard of claim 1, wherein the handle has a centerline, and the centerline of a substantial portion of the handle is substantially parallel to the top surface when the handle is in the second position.

3. The skateboard of claim 1, wherein the skateboard has a longitudinal axis extending between the front and rear portions, and the handle conforms to the profile of the top surface in the longitudinal direction.

4. The skateboard of claim 3, wherein the base is substantially flat.

5. The skateboard of claim 1, wherein the top surface includes front and rear end surfaces formed at the front and rear portions; and the handle has a first end coupled to the base, a second end having a grip, and each of the first and second ends has a centerline;

wherein when the handle is in the second position, the first end is disposed proximate to the front portion, the second end is disposed proximate to the rear portion, and each of the centerlines of the first and second ends are approximately parallel to first and second planes described by the respective front and rear end surfaces.

6. The skateboard of claim 1, wherein the handle includes a grip located proximate the rearward portion of the base when the handle is in the second position.

7. The skateboard of claim 1, further including a channel formed in the base, wherein a first end of the handle extends along the channel.

8. The skateboard of claim 7, wherein the channel is disposed at the front portion of the base.

9. The skateboard of claim 8, wherein the base extends between the front and rear portions in a longitudinal direction and the channel extends in a direction transverse to the longitudinal direction.

10. The skateboard of claim 1, wherein the handle is coupled to the base below the top surface.

11. The skateboard of claim 10, wherein the handle is coupled to the base above at least a portion of the lower surface.

12. The skateboard of claim 1, further comprising a lock connected to the handle, the lock including a gripping portion and a resilient portion, wherein the lock secures the handle relative to the base when handle is in each of the first position and the second position.

13. The skateboard of claim 12, wherein deformation of the resilient portion permits disengagement of the lock to selectively lock and unlock the handle.

14. The riding skateboard of claim 1, wherein the handle extends toward the other of the front and rear portions when in the second position; and a handle support connected to the handle and engageable with the top surface of the base to support the portion of the handle proximate the other of the front and rear portions when the handle is in the second position.

15. The skateboard of claim 14, wherein the handle support is engageable with the top surface substantially at a portion of the peripheral edge.

16. A skateboard comprising:

a base having a top surface and a lower surface;

a first wheel and a second wheel coupled to the lower surface of the base at a respective front end and rear end thereof, the first and second wheels being mounted to the base by a respective first truck and second truck;

a handle having an end coupled to the base and movable between a first position and a second position; and a lock disposed proximate to one of the first and second trucks and engageable with the handle end to selectively secure the handle relative to the base when the handle is in the first position to provide an upright position for the handle and when the handle is in the second position to provide the base free of obstruction by the handle.

17. The skateboard of claim 16, wherein the handle includes first and second receptacles, the first and second receptacles correspond to the first and second positions, respectively; and the lock includes a lock member configured for receipt by one of the receptacles to selectively secure the handle in the first and second positions.

18. The skateboard of claim 17, wherein the first and second receptacles are through holes and the lock member is a pin.

19. The skateboard of claim 16, wherein the lock is disposed below the base.

20. The skateboard of claim 19, wherein the lock is slidably mounted to the base.

21. The skateboard of claim 20, wherein the base has a longitudinal axis and the lock slides parallel to the longitudinal axis.

22. The skateboard of claim 16, wherein the lock is biased into engagement with the handle.

23. The skateboard of claim 16, wherein the lock includes a resilient grip portion.

24. The skateboard of claim 23, wherein deformation of the resilient grip portion permits disengagement of the lock with the handle to selectively lock and unlock the handle.

25. The skateboard of claim 16, wherein the lock includes a lock housing mounted to the lower surface of the base, the lock housing including a longitudinal indent and at least one clip indent;

a slider received in the longitudinal indent, the slider including at least one lock clip for mating engagement with the at least one clip indent to secure the slider.

26. The skateboard of claim 25, wherein the handle includes first and second receptacles, the first and second receptacles correspond to the first and second positions, respectively; and the slider includes a lock member configured for receipt by one of the receptacles to selectively secure the handle in the first and second positions.

27. The skateboard of claim 26, wherein a stop is located in the longitudinal indent and the slider includes a slot; and a spring is located in the slot and abutting the stop;

wherein the lock member is resiliently biased into engagement with one of the first and second receptacles.

28. The skateboard of claim 16, wherein the base has a front portion and a rear portion, the handle being coupled to one of the front and rear portions and extending toward the other of the front and rear portions when in the second position; and a handle support connected to the handle and engageable with the top surface of the base to support the portion of the handle proximate the other of the front and rear portions when the handle is in the second position.

29. The skateboard of claim 28, wherein the handle support is engageable with the top surface substantially at a portion, of the peripheral edge.

30. A skateboard convertible between a first riding configuration and a second riding configuration, the convertible skateboard comprising:

a base having a top surface and a peripheral edge;

a first truck-mounted wheel set;

a second truck-mounted wheel set;

a handle mounted to the base and movable between a first locked position where the handle is upright relative to the base to provide an assist handle for a rider of the skateboard and a second locked position where the handle lies substantially outside of the peripheral edge of the base when viewed from above the top surface so as to provide the top surface as a surface unobstructed by the handle.

31. The convertible skateboard according to claim 30, wherein no portion of the handle extends across the top surface of the base when the handle is in the second locked position.

32. The convertible skateboard according to claim 30, wherein the handle includes a hand grip for grasping the handle when the handle is in the first locked position; and the hand grip being disposed substantially along the peripheral edge when the handle is the second locked position.

33. The convertible skateboard of claim 30, wherein the first truck-mounted wheel set and the second truck-mounted wheel set are aligned along a longitudinal axis of the base; and the handle conforms to the profile of the top surface in the longitudinal direction.

34. The convertible skateboard claim 30, wherein the base further comprises a channel extending in a direction transverse to the longitudinal direction; and a portion of the handle extends in the transverse channel.

35. The convertible skateboard of claim 30, further comprising a lock mounted to the base and selectively engageable with the handle to lock the handle relative to the base when handle is in each of the first locked position and the second locked position and the lock including:

a gripping portion; and a resilient portion.

* * * * *